US005613788A

United States Patent [19]

Dobring

[11] Patent Number: 5,613,788

[45] Date of Patent: Mar. 25, 1997

[54] CUTTING DEVICE FOR CUTTING A PRINT CARRIER IN A PRINTER

[75] Inventor: Wilfried Dobring, Berlin, Germany

[73] Assignee: Siemens Nixdorf Informationssysteme Aktiengesellschaft, Paderborn, Germany

[21] Appl. No.: 545,664

[22] PCT Filed: Apr. 8, 1994

[86] PCT No.: PCT/DE94/00397

§ 371 Date: Nov. 2, 1995

§ 102(e) Date: Nov. 2, 1995

[87] PCT Pub. No.: WO94/26478

PCT Pub. Date: Nov. 24, 1994

[30] Foreign Application Priority Data

May 10, 1993 [DE] Germany ..... 43 15 507.3

[51] Int. Cl.[6] ..... B41J 11/68

[52] U.S. Cl. ..... 400/621; 101/93.07; 83/879; 83/697

[58] Field of Search ..... 400/621; 101/93.07, 101/226, 224; 83/879, 697, 530

[56] References Cited

U.S. PATENT DOCUMENTS

| | | | |
|---|---|---|---|
| 3,941,228 | 3/1976 | Ueiser | 400/621 |
| 4,211,498 | 7/1980 | Shimizu et al. . | |
| 4,312,597 | 1/1982 | Shimizu et al. | 400/621 |
| 4,451,167 | 5/1984 | Honma et al. | 400/621 |
| 4,544,293 | 10/1985 | Cranston et al. | 400/621 |
| 4,732,068 | 3/1988 | Yasuda et al. . | |
| 5,259,681 | 11/1993 | Uitazawa | 400/621 |

FOREIGN PATENT DOCUMENTS

| | | | |
|---|---|---|---|
| 0017014 | 10/1980 | European Pat. Off. | 400/621 |
| 57692 | 7/1891 | Germany . | |
| 825611 | 7/1949 | Germany . | |
| 2420841 | 4/1976 | Germany . | |
| 70929 | 9/1983 | Germany . | |
| 3320613 | 12/1984 | Germany | 400/621 |
| 3445744 | 6/1986 | Germany . | |
| 4114486 | 11/1992 | Germany . | |
| 0106982 | 6/1984 | Japan | 400/621 |
| 401258972 | 10/1989 | Japan | 400/621 |
| 0032868 | 2/1991 | Japan | 400/621 |
| 0249374 | 9/1987 | Russian Federation | 400/621 |

OTHER PUBLICATIONS

*IBM Technical Disclosure Bulletin*, vol. 32, No. 3B, Aug. 1989, pp. 421–422. "Customer Replaceable Cash Receipt Cutter".

"Receipt Paper Cutoff Mechanism" IBM Technical Disclosure Bulletin, vol. 31, No. 5 Oct. 1988 pp. 414–415.

*Primary Examiner*—Eugene H. Eickholt

*Attorney, Agent, or Firm*—Hill, Steadman & Simpson

[57] ABSTRACT

A cutting device for cutting a print carrier in a printer (10), especially in a till printer, has a blade (22) which is movable along at least one guideway (28) against a fixed counter-blade (24) and which, in an open setting, frees an opening (20) to allow the printer carrier to be passed through and, in a closed setting, has at least partially cut through the print carrier. The blade (22) can be moved between the open setting and the closed setting by an adjusting mechanism. The blade (22) has at least two guide elements (38), which are disposed at a distance apart on the side facing away from the cutter (42) of the blade (22). The adjusting mechanism (30) engages in the guide elements (38) in order to adjust the blade (22).

17 Claims, 6 Drawing Sheets

FIG 1
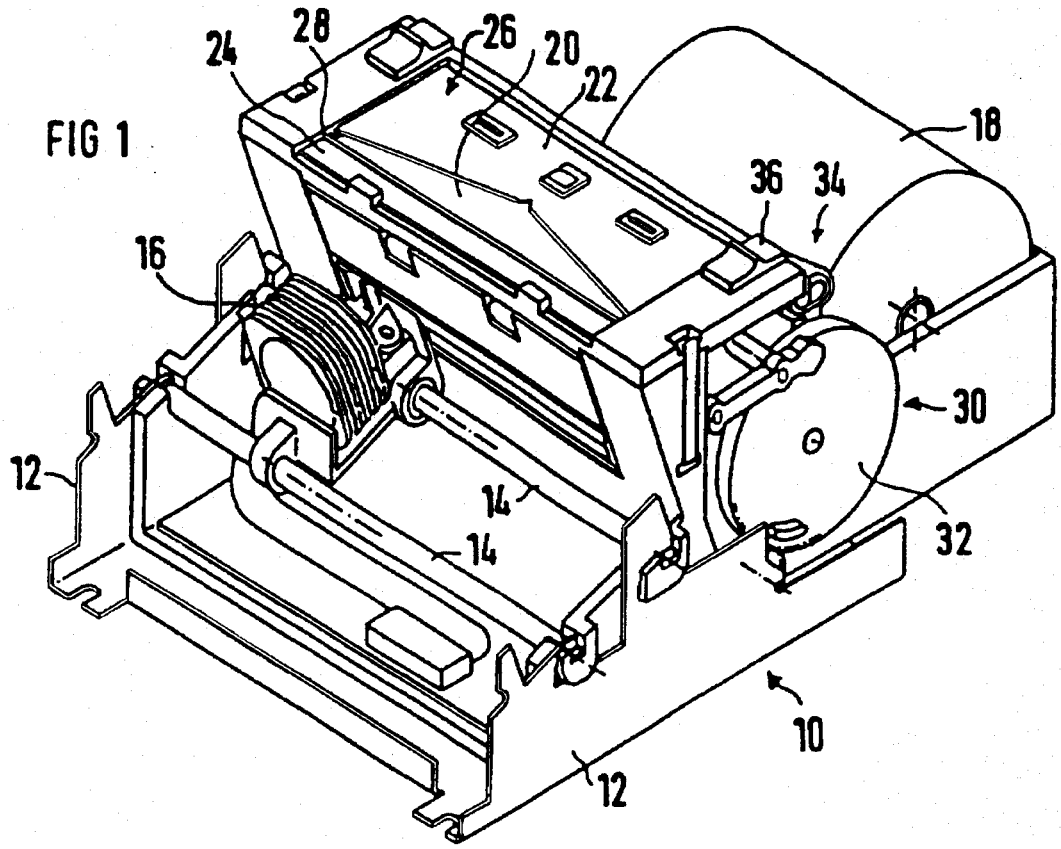
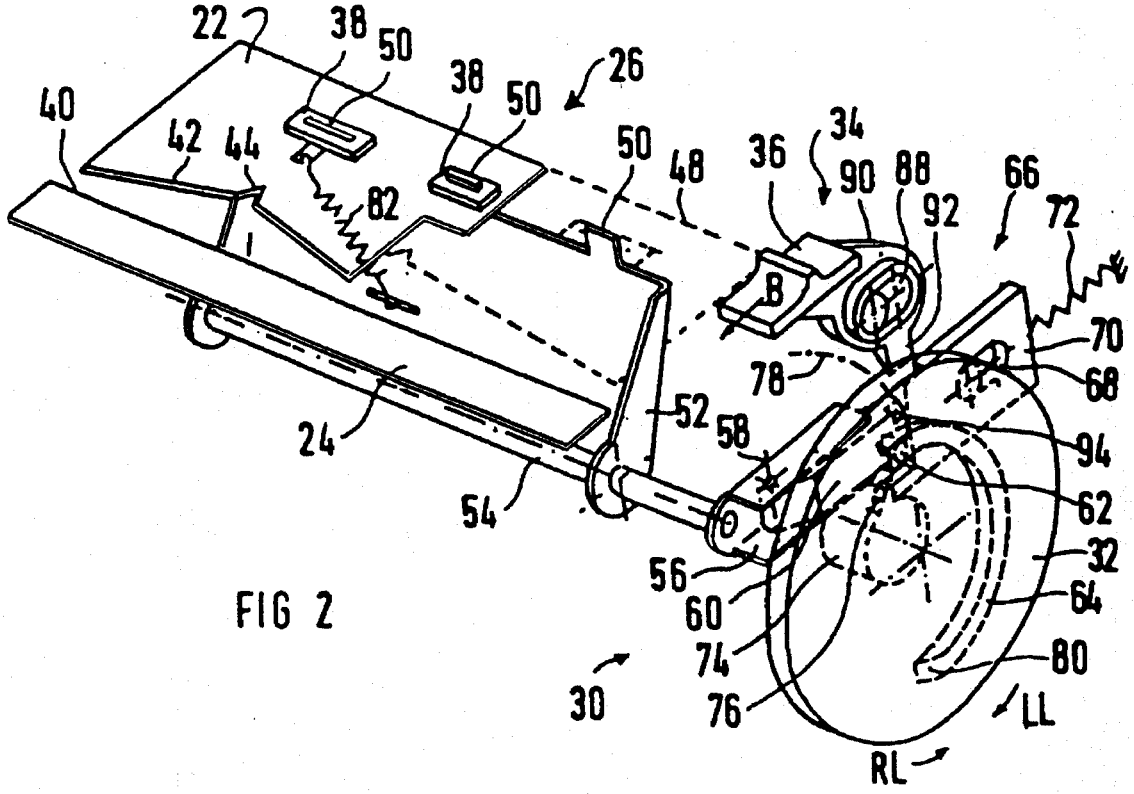
FIG 2

CUTTING DEVICE FOR CUTTING A PRINT CARRIER IN A PRINTER

BACKGROUND OF THE INVENTION

The invention relates to a cutting device for cutting a print carrier in a printer, especially in a cash register or till printer, having a blade which is movable along at least one guideway against a fixed counterblade. In an open setting, the blade frees an opening to allow the print carrier to be passed through. In a closed setting, the blade has at least partially cut through the print carrier. The blade is moveable between the open setting and the closed setting by an adjusting mechanism.

A cutting device is disclosed in DE 34 45 744 A1. It serves optionally to deliver a starting cut or severance cut to a paper strip in a till printer. The blade is connected to a slide block, which is guided in an eccentric slideway of a slotted linkplate. Upon rotary motion of the slotted linkplate, the blade performs a stroke motion, the paper roll being fully or only partially cut through depending upon the direction of rotation of the linkplate. Upon the cutting motion, cutting forces are generated which can result in the blade being tilted. Consequently, the guideways incur wear and the quality of the cut may be adversely affected.

SUMMARY OF THE INVENTION

An object of the invention is to specify a cutting device which operates with a high cut quality and low wear.

This object is achieved for a cutting device improved over the type stated in the introduction in the blade has at least two guide elements, which are disposed at a distance apart on that side of the blade facing away from the cutter of the blade, and that the adjusting mechanism for adjusting the blade engages in the guide elements.

The invention has the effect that the adjusting mechanism guides the blade, at at least two points, along the guideway. The blade is consequently unable to tilt, even where laterally directed cutting forces are generated. The guideway on which the blade slides is thus subjected to less wear. Furthermore, as a result of the precise guidance of the blade, the cut is evenly executed, thereby producing a high cut quality. In addition, the force which is necessary for the cutting is induced at a plurality of points on the blade, so that lower component forces are generated at the corresponding guide elements also. The wear to the bearings is thereby reduced and the cutting device functions more reliably overall.

In a preferred illustrative embodiment of the invention, plastic bearings are used as guide elements, in which journals of the adjusting mechanism engage. These plastics bearings can be inserted into corresponding openings in the blade such that they lock in place by means of a clip fastening, thereby making for simple assembly. The use of plastic bearings means that the journals slide without much friction in the guide element, so that the force expended remains small and wear is further reduced.

In another illustrative embodiment, the guideways are disposed in a plane running parallel to the face of the counterblade on which the blade slides during the cutting operation, the plane being disposed at a small distance beneath the face. As a result of these measures, production tolerances are counterbalanced, thereby making for an inexpensive cutting device construction in overall terms.

A refinement of the abovementioned embodiment provides that the outer corners of the cutter segments run obliquely upward such that, during the cutting motion, the blade is guided onto the face of the counterblade. As a result of these measures, the operating reliability of the cutting device is guaranteed, even where the face of the counterblade and the plane of the guideways are relatively far apart.

Another refinement is characterized in that the blade is guided under spring pressure against the guideways. The spring pressure can be chosen such that the blade, in a region between the guideways, sags slightly downward. This means that the cutter of the blade bears closely throughout its length against the cutter of the counterblade and thus produces a clean cut. In addition, the cutters of the blade and counterblade are given a self-sharpening effect by these measures.

Additional features and advantages of the present invention are described in, and will be apparent from, the detailed description of the presently preferred embodiments and from the drawings.

BRIEF DESCRIPTION OF THE DRAWINGS

An illustrative embodiment of the invention is explained below with reference to the drawing, in which:

FIG. 1 shows a till printer having a cutting device which is driven by an adjusting mechanism, FIG. 2 shows a diagrammatic representation of the cutting device which is actuated by the adjusting mechanism.

DETAILED DESCRIPTION OF THE PRESENTLY PREFERRED EMBODIMENTS

Figure 3A:
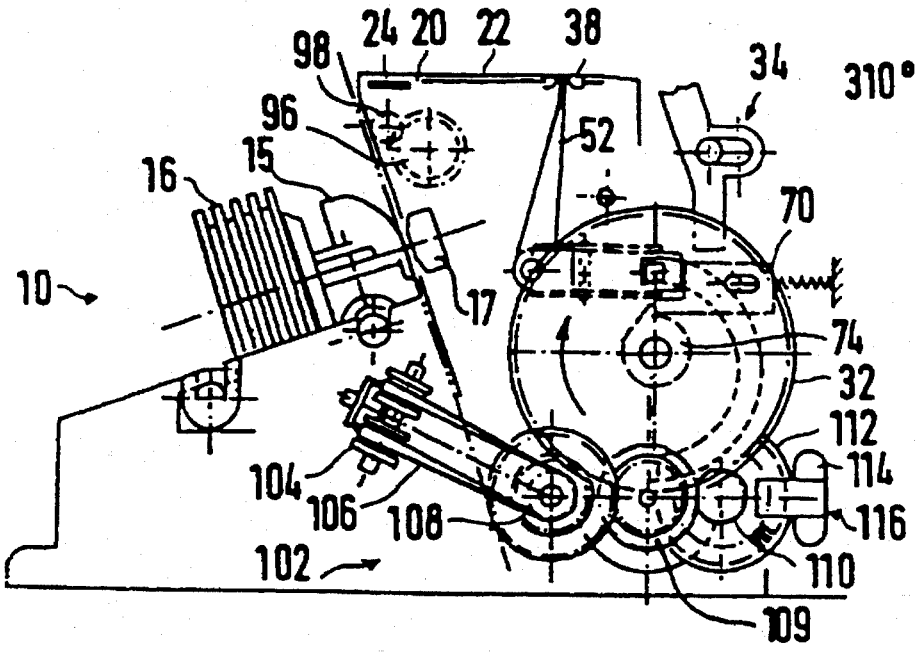
FIG. 3*a* shows a diagrammatic view of the adjusting mechanism from the side.

FIG. 1 depicts a till printer 10, in whose side walls 12 there are mounted guide rails 14. These guide rails 14 guide a printing-head holder 16 along a path running parallel to a line to be printed. Between the side walls 12 there is mounted a paper feed roller 18, the paper roll of which is guided past the printing head (not represented), via a print dolly (not represented), in order to be imprinted. The paper roll is guided through an opening 20 between a blade 22 and a counterblade 24 of a cutting device 26. This cutting device 26 is represented in FIG. 1 in its open setting.

At the sides the blade 22 is mounted on guideways 28, of which only one is visible. An adjusting mechanism 30 having a plate cam 32 actuates the blade 22 in order to cut the paper roll. Using a switchover mechanism 34, it is possible to set whether the paper roll shall be fully or only partially cut through. For this purpose, an actuating button 36 has to be adjusted.

FIG. 2 illustrates in diagrammatic view the cutting device 26 together with the adjusting mechanism 30. The blade 22 has two plastic guide elements 38 which are spaced apart and the connecting line of which runs roughly parallel to the cutting edge 40 of the counterblade 24. The blade 22 is a stamped metal part, which is made from thin spring plate. The counterblade 24 is made from a stable spring-band strip, which is inserted into the slot in a plastic mounting. The blade 22 has a cutter 42 comprising two cutter segments, which run from the middle of the cutter obliquely forward and outward in the direction of the cutting motion. In the middle of the cutter 42 there is sunk a recess 44 in a V-shape, the tip of which faces away from the counterblade 24. This cutter shape results in the blade 22 being centred during the cutting motion, so that a high-grade cut is obtained. The blade 22 can be shaped to match the width of the paper roll to be cut. In the present example, the blade 22 has a cutout 46 in order to reduce the width of the cutter 42. In an embodiment 48 portrayed in dashed representation, the blade has an enlarged width and three guide elements 38.

The guide elements 38 of the blade 22 are mounted on journals 50 of a pivot bracket 52, which is rigidly connected to a pivot shaft 54, which, in turn, is mounted rotatably in the printer housing. Upon rotation of a plate cam 32, the pivot shaft 54 is able to be pivoted. The pivot shaft 54 is rigidly connected, at the end facing the plate cam 32, to a U-shaped shackle 56. An engaging lever 60 is pivotally secured to the shackle 56 to be relatively pivotable about a rotational axis 58. The engaging lever 60 is pretensioned with a spring (not represented) in the direction of the plate cam 32. It supports at its outer end a control pin 62, which is forced by the aforementioned spring elastically against the plate cam 32.

The plate cam 32 has a control groove 64 running generally in a circumferential direction, the radial distance of which from the midpoint of the plate cam 32 increases over the angle of rotation in the direction of the arrow LL. The engagement of the control pin 62 in the control groove 64 can be prevented by a blocking mechanism 66, which covers the control groove 64 with a blocking bolt 70 which is slidably guided in a long hole 68 disposed therein. A pressure spring 72 pretensions the bolt 70 in the direction of the pivot shaft 54.

When the plate cam 32 is rotated in the direction of the arrow LL, a control cam 74 which is fixedly connected thereto displaces the bolt 70 to the right in FIG. 2 by means of a boss 76 and releases the control pin 62, so that this can engage in the control groove 64. Upon this rotation, the plate cam 32 is twisted to an angle of rotation which is not attained whilst a line is being printed. Upon subsequent rotation of the plate cam 32 in the direction of the arrow RL, the control pin 62 is guided in the control groove 32, whereupon the engaging lever 60 performs a stroke along a control way 78. This stroke is transmitted by the shackle 56 via the pivot shaft 54 and pivot bracket 52 to the blade 22, which moves out of the open setting into a closed setting against the counterblade 24, cutting through the paper strip as it does so.

The control groove 64 diminishes in depth at its radially most distal end, forming a curved outlet 80, which guides the control pin 62 out of sliding engagement with the control groove 64. Close to the recess 44, the blade 22 is connected by a tension spring 82 to the pivot bracket 52 such that the cutter 42 of the blade 22 is pretensioned in the direction of the pivot bracket. This pretensioning also causes the blade to be withdrawn into its open setting. Due to the force of the tension spring 82, the pivot bracket 52 swivels together with the engaging lever 60 back into its original position, corresponding to the open setting shown in FIG. 2.

The stroke of the blade 22 is dimensioned such that, when the control pin 62 is guided by the curved outlet 80 out of the control groove 64, the recess 44 covers the cutting edge 40 of the counterblade 24. The paper strip is then totally cut through. If the paper strip is meant to be only partially cut through, then the stroke of the control pin 62 has to be reduced. To this end, a switchover mechanism 34 is provided, which is manually actuated using an actuating button 36. The switchover mechanism 36 has an actuating element 90, which is guided in a long hole 88 and has at its end facing the engaging lever 60 a wedge-shaped flange 92. When the actuating element 90 is displaced in the arrow direction B, the flange 92, upon the motion of the engaging lever 60 in the radial direction, engages in an obliquely running recess 94 configured on said engaging lever and guides the control pin 62 out of the control groove 64 before it reaches its maximum stroke on the curved outlet 80, whereby the paper strip is only partially cut through. Through the force of the spring 82, the blade 22 is returned to its open setting into a specific position.

Figure 3B:
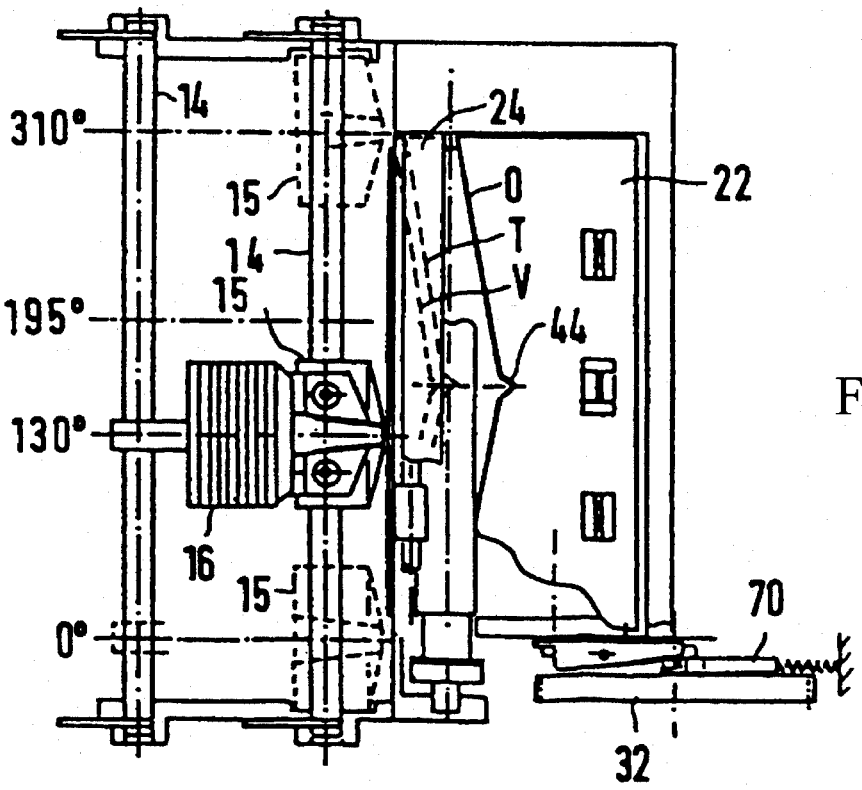
FIG. 3*b* shows a diagrammatic view of the adjusting mechanism from above.

FIG. 3*a* and 3*b* show in diagrammatic representation a side view and top view respectively, of the till printer 10. Inserted in the printing-head holder 16 there is a printing head 15, which is opposed by a print dolly 17. Between the printing head 15 and the print dolly 17 there is guided a paper roll (not represented) which is to be imprinted and which, by means of a transport roller 96 and counter-pressure roller 98, is conveyed onward and delivered from the opening 20 between the blade 22 and counterblade 24. The motion of the printing head 15 in the line direction is transmitted via a gear system 102 to the plate cam 32. The gear system 102 has a motor-driven drive gearwheel 109. The rotary motion of the drive gearwheel 109 is transmitted to the gearwheels 108, 110, whereupon the gearwheel 108 engages in the gear rim of the plate cam 32. The gearwheel 108 drives a toothed belt 106, which is guided via a deflection roller 104 and moves the printing-head carrier 16.

The gearwheel 110 supports an angle-coding disk 112, the coding of which is read by a sensor 114. The angle-coding disk 112 and sensor 114 form a rotational-angle transmitter 116, the signals from which are analyzed in order to control the printing head 15 in the line direction.

The gear system 102 converts the linear motion of the printing head 15 in the line direction into a rotary motion of the plate cam 32. The transmission of the gear system 102 is chosen such that the plate cam 32, upon motion of the printing head 15 in the line direction, does not fully perform a complete revolution. The angular settings of the plate cam 32 which belong to the various positions of the printing head 15 are indicated in the top view of FIG. 3*b*.

The blade 22 can assume three operating settings. The blade 22 represented with unbroken lines in the top view of FIG. 3*b* shows the open setting O. The cutter 42 of the blade 22 can also assume settings T and V, which are shown in dashed representation. In the setting V, the recess 44 slides fully over the cutting edge 40 of the counterblade 24. In this setting V, the paper strip is fully cut through. In the setting T, the cutter 42 slides only up to the recess 44 over the cutting edge 40. In this setting T, a crossweb of the paper strip remains intact, i.e. the paper strip is only partially cut through.

Figure 4A:
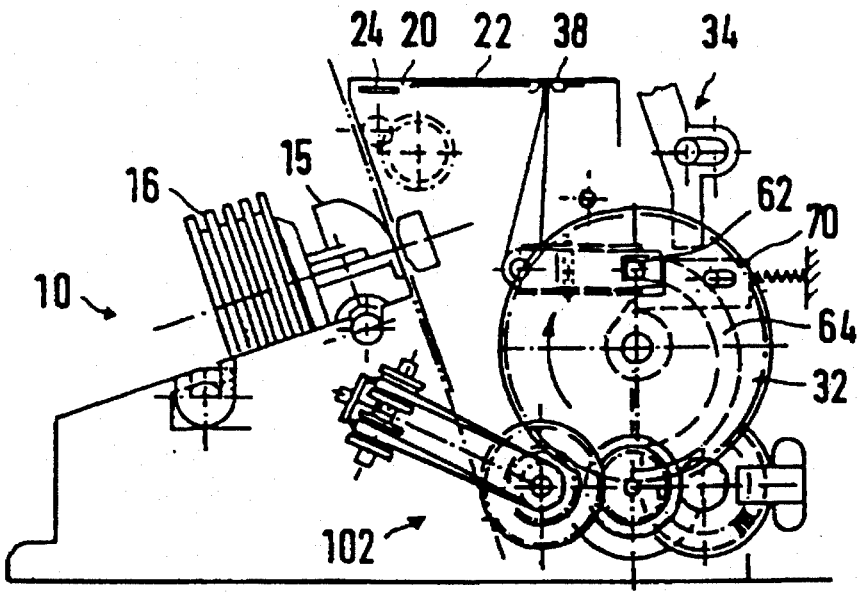
FIGS. 4*a* and 4*b* show diagrammatic views of the adjusting mechanism in a state in which the cutting device is activated.
Figure 4B:
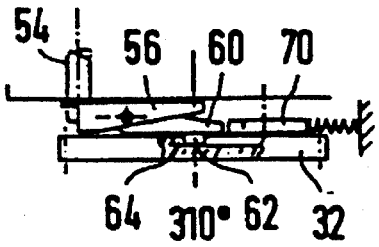

FIG. 4*a* shows a diagrammatic view of the adjusting mechanism from the side, in a state in which the cutting device is activated. The printing head 15 herein has a position corresponding to an angular setting of the plate cam 32 of 310° (cf. FIGS. 3 and 2). In this state, the boss 76 of the control cam 74 has displaced the bolt 70 to the right, so that the control pin 62 engages in the control groove 64. Upon subsequent rotation of the plate cam in the reverse direction, the control pin 62 performs a swivel motion upward in the radial direction of the plate cam 32.

Figure 5A:
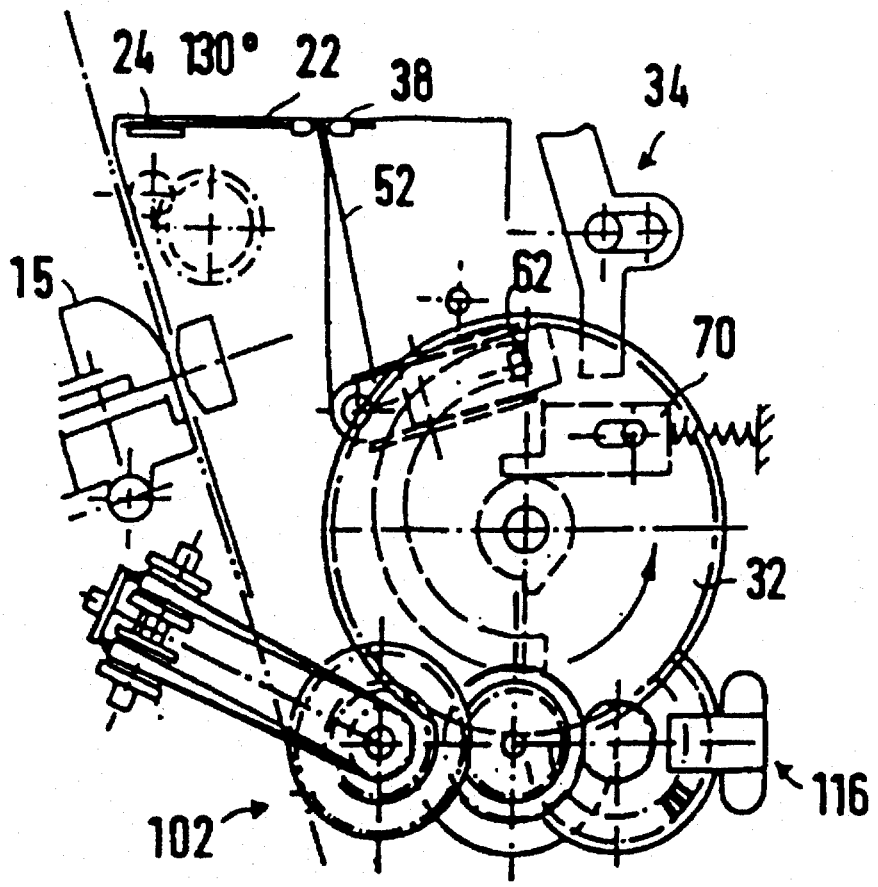
FIGS. 5*a* and 5*b* show diagrammatic views of the adjusting mechanism in a state in which the blade performs a full cut.
Figure 5B:
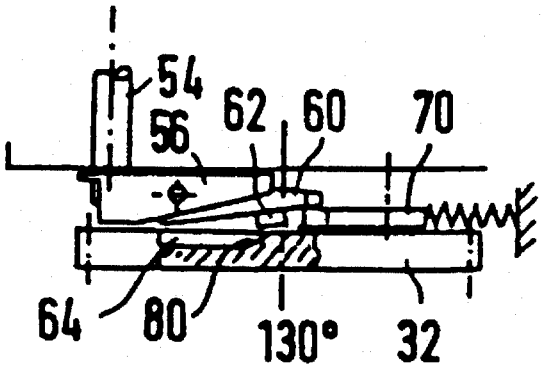

In FIG. 5*a* and 5*b*, the plate cam 32 is in the angular setting 130° (cf. in this context the setting of the printing head 15 in FIG. 3*a* and 3*b*). The control pin 62 has reached its maximum stroke at a maximum distance from the middle of the plate cam 32, so that the blade 22 has fully cut through the paper strip (setting V in FIG. 3). As can be seen in the lower picture segment of FIG. 5, the control pin 62 is guided by the curved outlet 80 out of the control groove 64, thereby enabling the pivot shaft 54, under the force of the spring 82, to swivel back into the open setting.

Figure 6A:
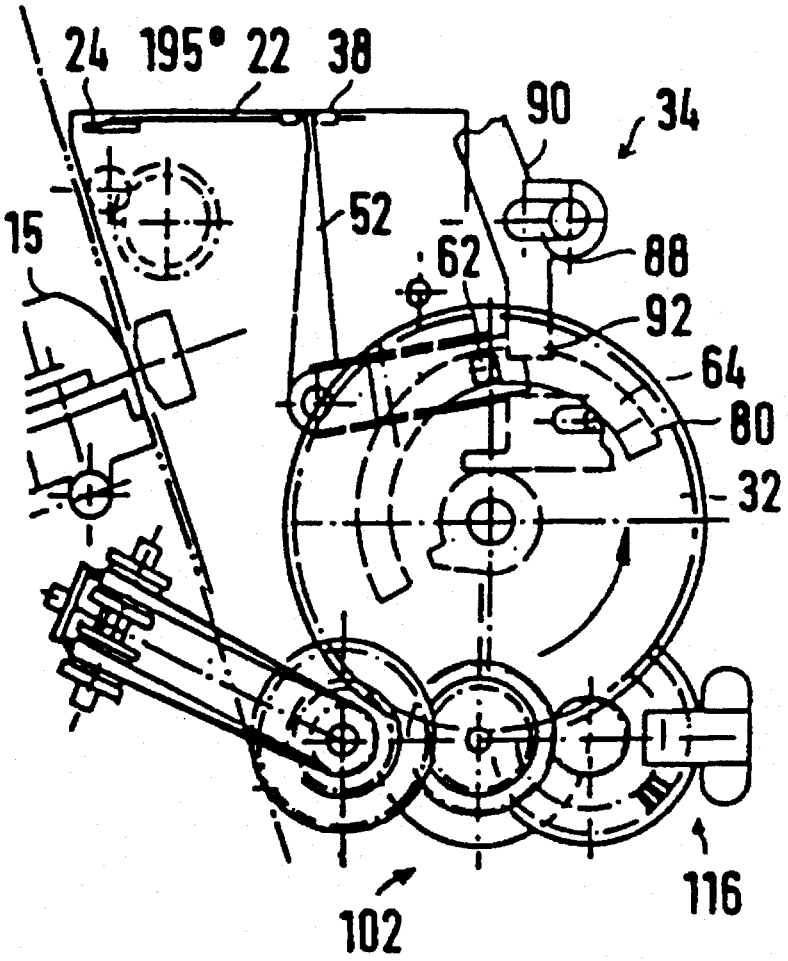
FIG. 6*a* and 6*b* show diagrammatic views of the adjusting mechanism in a state in which a part-cut is executed.
Figure 6B:
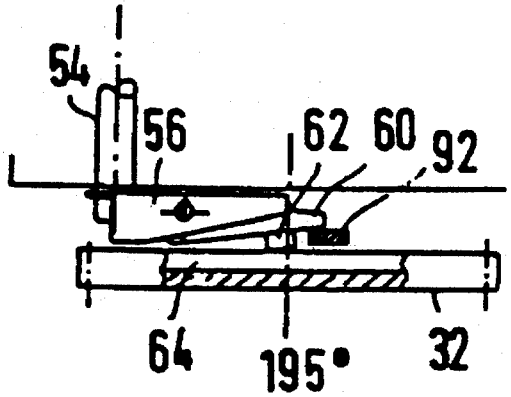

FIGS. 6*a* and 6*b* shows a diagrammatic view of the adjusting mechanism in a state in which the blade 22 performs a partial cut. The printing head 15 is moved for this purpose into a setting corresponding to an angular setting of the plate cam 32 of 195° (cf. FIG. 3*a* and 3*b*). The actuating element 90 of the switchover mechanism 84 is in a setting which is displaced in the direction of the arrow B and engages with its flange 92 in the front end of the engaging lever 60, which has been moved radially upward. The control pin 62 is thereby released from the control groove 64 before it reaches its maximum radial distance from the midpoint of the plate cam 32. Due to the reduced stroke of the blade 22, this reaches a setting (setting T in FIG. 3*b*) in which the paper strip is only partially cut through.

Figure 7:
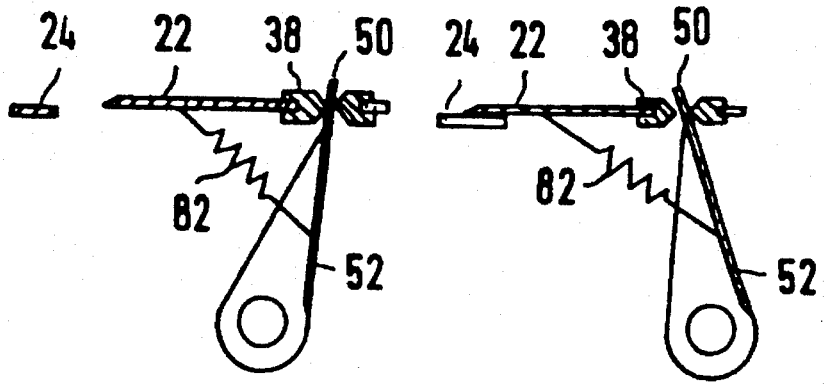
FIG. 7 shows a section through the blade and pivot bracket.

FIG. 7 depicts a diagrammatic cross section through the blade 22 and pivot bracket 52, which cross section illustrates the working method of the spring 82. This is disposed between the blade 22 and pivot bracket 52 such that it biases to reduce the angle between the blade 22 and pivot bracket 52. The blade 22 is thereby forced in the cutting motion against the guideways 28 or the counterblade 24, thereby producing a smooth cut. The guide elements 38 form a pointedly tapered plain bearing for the journals 50 of the pivot bracket. In this type of mounting, precise guidance combined with a low degree of play and low bearing wear is guaranteed.

Figure 8:
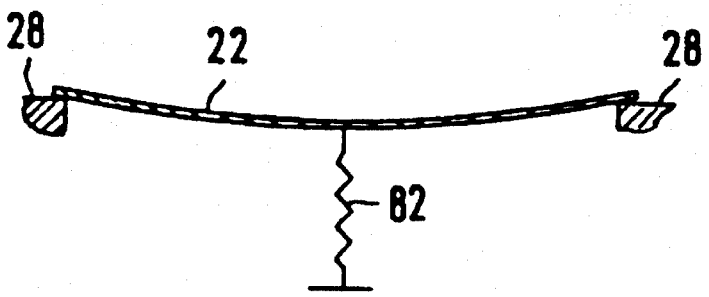
FIG. 8 shows a basic representation of the blade in the resiliently pretensioned state.

As is shown in FIG. 8, the spring 82 additionally has the effect that the blade 22 is made to sag slightly between the guideways 28. The sag can measure, for example, 0.5 to 1 mm. As a result of this sag, a shearing, precise cut through the paper strip is obtained.

Figure 9:
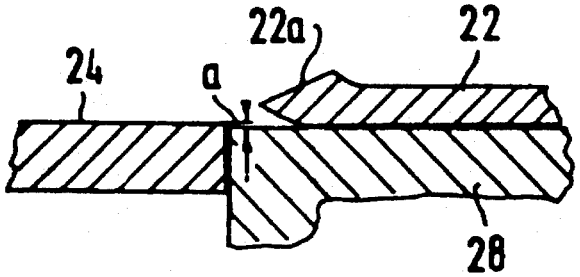
FIG. 9 shows a section through the counterblade and blade with bent-up cutter ends.

FIG. 9 illustrates that the guideways 28 are disposed in a plane running parallel to that upper face of the counterblade 24 on which the blade 22 slides during the cutting operation. The plane of the guideways 28 lies slightly beneath the face of the counterblade 24. The distance a measures, for example, 0.1 to 0.2 mm. This height difference serves to counterbalance production tolerances. The corners 22*a* of the blade 22 run obliquely upward, thereby forming a run-up slope. The run-up slope can be created by the corners 22*a* being bent or ground down. As a result of these measures, the height difference between the plane of the guideways 28 and the upper face of the counterblade 24 during cutting motions is eliminated.

It should be understood that various changes and modifications to the presently preferred embodiments will be apparent to those skilled in the art. Such changes and modifications may be made without departing from the spirit and scope of the present invention. Therefore, such changes and modifications are intended to be covered by the appended claims.

What is claimed is:

1. A cutting device for cutting a print carrier in a printer, the cutter comprising:

a blade which is movable along at least one guideway against a fixed counterblade and which, in an open setting, frees an opening to allow the printer carrier to be passed through and, in a closed setting, has at least partially cut through the print carrier;

a pivot bracket pivotable to move the blade between the open setting and the closed setting;

a rotatable plate cam arranged to pivot the pivot bracket, the plate cam having a control groove running in a generally peripheral direction, the radial distance of which from the midpoint of the plate cam increases over a rotational angle of the plate cam;

an engaging lever connected to the pivot bracket to pivot therewith, the engaging lever having a control pin secured thereon, such that the control pin is moveable between engaged and disengaged positions relative to the control groove;

a blocking mechanism operable to selectively prevent engagement of the control pin with the control groove, which can lock the engagement of the control pin in the control groove;

a control cam fixed to rotate with the plate cam such that upon rotation of the plate cam about a first predetermined angle of rotation, the control cam causes the blocking mechanism to permit engagement of the control pin in the control groove; and a selectively actuatable switchover mechanism which releases the control pin from the control groove when the control pin has moved a predefined radial distance in the control groove relative to the plate cam.

2. The cutting device as claimed in claim 1, wherein the pivot bracket is rigidly connected to a pivot shaft mounted rotatably on the frame of the cutting device.

3. The cutting device as claimed in claim 2, wherein the pivot bracket is biased by a spring into a setting in which the blade is in the open setting.

4. The cutting device as claimed in claim 1, wherein the control groove includes a curved outlet positioned in a predetermined rotational angle of the plate cam, which, upon rotation of the plate cam, disengages the control pin from the control groove.

5. The cutting device as claimed in claim 1, wherein deactuation of the switchover mechanism permits radial movement of the control pin relative to the plate cam such that the blade cuts fully through the print carrier, and wherein actuation of the switchover mechanism permits radial movement of the control pin relative to the plate cam such that the blade cuts only partially through the print carrier.

6. The cutting device as claimed in claim 1, wherein the blade includes at least two spaced apart guide elements disposed at a distance apart on a side of the blade facing away from the pivot bracket such that the pivot bracket engages in the guide elements in order to move the blade.

7. The cutting device as claimed in claim 6, wherein the guide elements are plastic bearings in which journals of the pivot bracket engage, the journals being mounted to slide between tips of the guide elements.

8. The cutting device as claimed in claim 6, wherein the cutter of the blade includes two cutter segments which run oppositely from the middle of the cutter obliquely forward and outward in the direction of the cutting motion.

9. The cutting device as claimed in claim 8, further comprising a V-shaped recess generally at a center of the blade between the two cutter segments, the V-shaped recess opening toward the counterblade.

10. The cutting device as claimed in claim 1, wherein the blade rests at its outer sides on guideways.

11. The cutting device as claimed in claim 10, wherein the guideways are disposed in a plane running parallel to a face of the counterblade on which the blade slides during the cutting operation, the plane being a slightly offset from the face.

12. The cutting device as claimed in claim 11, wherein outer corners of the cutter segments run obliquely upward such that, during the cutting motion, the blade is guided onto the face of the counterblade.

13. The cutting device as claimed in claim 1, wherein the blade is guided under spring pressure against two guideways.

14. The cutting device as claimed in claim 13, wherein the spring pressure causes the blade to deflect slightly downward between the guideways.

15. The cutting device as claimed in claim 1, wherein the blade and the counterblade are stamped metal elements, which are made from thin spring-band steel.

16. The cutting device as claimed in claim 1, wherein the counterblade includes a stable spring-band strip, which is held by a plastic part.

17. The cutting device as claimed in claim 10, wherein the guideways are made of plastic.

* * * * *